United States Patent [19]

Tursi et al.

[11] 4,409,928

[45] Oct. 18, 1983

[54] STANDARDIZED COMPACT MODULAR BOILER

[75] Inventors: Thomas P. Tursi, Horsham, Pa.; Thomas R. Millington, Woodbury, N.J.

[73] Assignee: The United States of America as represented by the Secretary of the Navy, Washington, D.C.

[21] Appl. No.: 317,040

[22] Filed: Nov. 2, 1981

[51] Int. Cl.[3] ..... F22D 7/00

[52] U.S. Cl. ..... 122/406 S; 60/39.18 A; 122/492; 110/234

[58] Field of Search ..... 122/486, 491, 492, 406 R, 122/406 S, 209 R, 209 A; 60/39.18 B; 110/234

[56] References Cited

U.S. PATENT DOCUMENTS

| | | | |
|---|---|---|---|
| 292,146 | 1/1884 | Stout | 122/486 |
| 2,568,024 | 9/1951 | Pfenninger | 60/39.18 B |
| 3,331,202 | 7/1967 | Brunner . | |
| 3,756,029 | 9/1973 | Aguet | 60/39.18 B |

*Primary Examiner*—Edward G. Favors
*Assistant Examiner*—Steven E. Warner
*Attorney, Agent, or Firm*—Robert F. Beers; Henry Hansen

[57] ABSTRACT

A compact and modularized boiler is comprised of interconnected modules. Each module is removable and replaceable with an identical module for easy on site repair. The modules are separated physically and in function as a supercharger module connected to provide compressed air; a burner module connected to receive fuel and compressed air for combustion; a furnace module housing a combustion chamber for receiving hot gas from the burner module and water to be heated from a pump module; a steam drum module for separating liquid and steam; a superheater module interfaced with the furnace module for generating superheated steam; and a convection module for providing additional surface area for heat transfer from the hot gas to the working liquid. The boiler is compact and modular.

3 Claims, 3 Drawing Figures

STANDARDIZED COMPACT MODULAR BOILER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention is related to a boiler system which is generally intended for providing steam power for propulsion of a ship, and more paticularly to a boiler system which is comprised of standardized, compact modules designed for quick and easy changeout and arranged to facilitate removal and replacement of any individual module.

Many Naval frigates are typically equipped with supercharged boilers which are vertically down-fired, natural-circulating units. The air is supplied from a supercharger to a windbox and divided equally among three burners which fire downward into a furnace. Fuel supplied by an oil pump is intimately mixed with the air and ignited. The products of combustion flow downward through the furnace across furnace screen tubes, across a superheater directly behind the furnace screen tubes and then across convection screen tubes located directly behind the superheater. The gas finally enters a pipe leading to a gas turbine which drives the supercharger. The furnace and convection screen tubes, and the superheater are integrally positioned within a single shell liner.

Due to the integrated design configuration of the boiler components of the prior art, severe limitations arise. For example, periodic repairs and overhauls are time consumming, costly and labor intensive, and must be performed in ship's fire rooms under adverse conditions; each boiler configuration, being nonstandard, results in a proliferation of spare parts, technical manuals, repair procedures and training. The output of existing boilers cannot be readily upgraded to supply increased quantities of steam to meet additional demands, and advanced technologies and materials cannot be readily backfit into existing ships or boilers because of space or configuration limitations.

SUMMARY OF THE INVENTION

Accordingly, a general purpose and object of the present invention is to provide a novel, compact, modular boiler for generating steam which is superior to existing ship propulsion boilers and which is particularly suitable for standardization. Another object is to provide a boiler to which repairs and overhaul can be completed by quickly replacing defective component modules in lieu of on-ship repair or rebuilding. Still another object is to provide a compact, modular boiler having one capacity which can be used on all ships, and in which ships having high steam demands can use a plurality of standardized, compact, modular boilers. Yet another object is to provide a boiler which combines forced circulation of boiler water along with pressure-fired combustion resulting in a boiler of extremely compact size and low height.

Briefly, these and other objects of the present invention are accomplished with a plurality of interconnected modules each of which may be removed and replaced with an identical module for easy repair on board ship. The modules are separated as a supercharger connected to provide compressed air to a burner module; a furnace module receiving hot gases from the externally interfaced and easily removable burner module and water from a ciculating pump module; a steam drum module for separating and mechanically drying the steam; a superheater module externally interfaced with the furnace module for heating the steam with combustion gases from the furnace module. A convection module externally interfaced with the superheater module for providing an increased surface area to permit maximum transfer of heat from the hot gases to the working liquid. The combustion gases pass through the furnace, superheater and convection modules, then power the supercharger via a gas turbine, and are exhausted to the atmosphere. Pressure firing of the boiler allows a significant reduction in the furnace size but still allows for completion of combustion and high gas velocities over heat transfer surfaces. As a result, the quantity of heat transfer surface required is reduced. The boiler may also use forced circulation of boiler water to allow vertical height reduction in the boiler design permitting greater flexibility in the location and arrangement of major boiler proponents, although natural circulation can also be employed.

These and other objects of the instant invention can be more readily understood, and the uniqueness of the boiler, more particularly the standardized, compact, modular boiler as well as its manner of construction and use will be more readily appreciated from the following detailed description, taken in conjunction with the accompanying drawings forming a part thereof, in which:

DESCRIPTION OF THE PREFERRED EMBODIMENT

Figure 3:
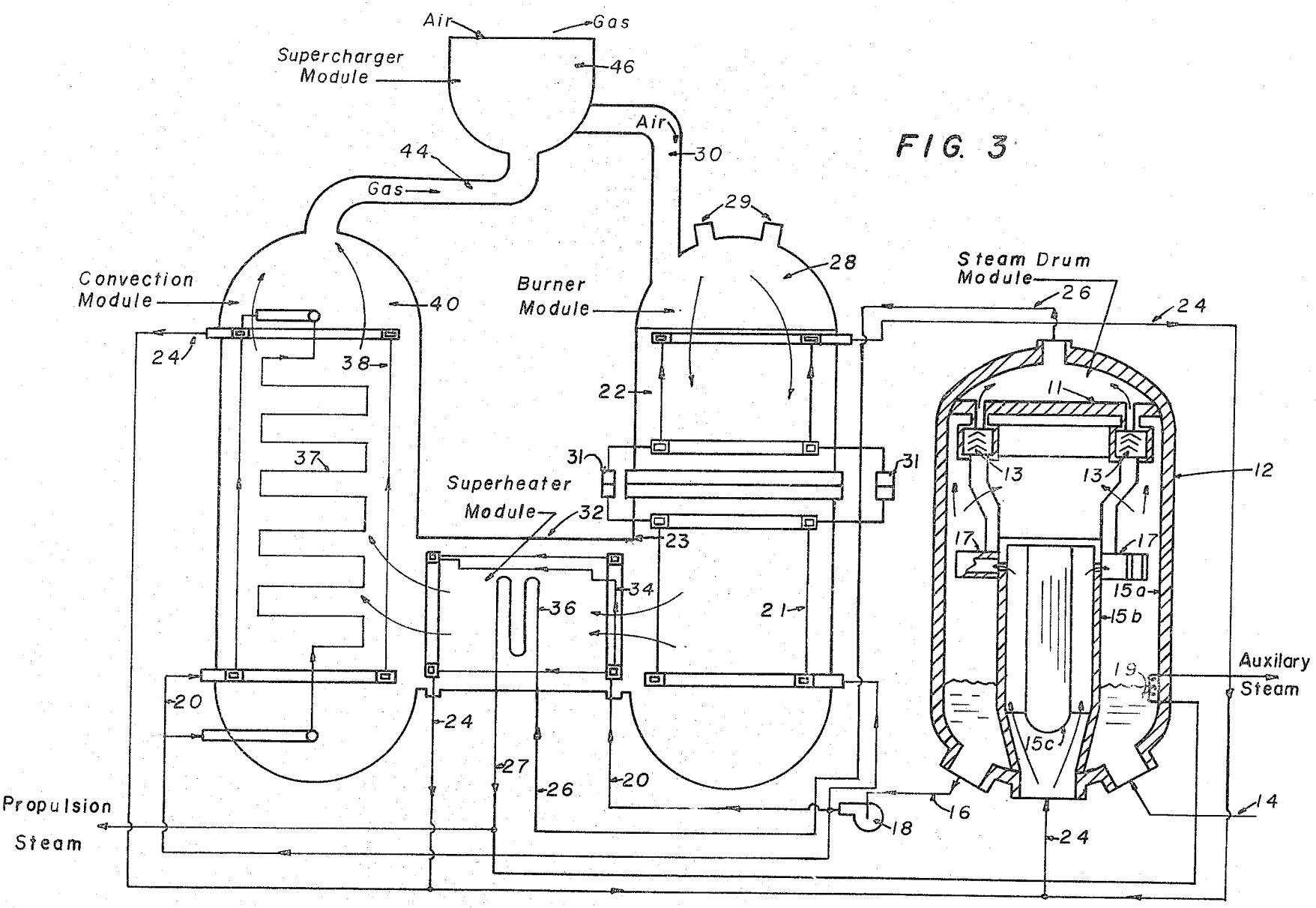
FIG. 3 is a schematic flow diagram of the boiler of FIG. 1.

Referring now to the drawings, wherein like reference characters designate like or corresponding parts throughout the several views, there is illustrated a standardized, compact, modular (SCM) boiler 10. A steam drum module 12 is connected to receive feedwater through an inlet line 14. Module 12 is a vertical cylinder having at the bottom two inlets from feedwater line 14 and steam and water mixture line 24; and an outlet connection to saturatedwater line 16. At the top there is one outlet to saturated steam line 26. Referring to FIG. 3, a flat circular plate 11 in the top of module 12 supports chevron dryers 13. Parallel steam and water flow paths are formed by the outer shell 15*a* and concentric cylinders 15*b* and 15*c*. The steam and water mixture enters through line 24 and is deflected into the riser annulus between cylinders 15*b* and 15*c* by the hemispherical head on the bottom of cylinder 15*c*. The top of the riser annulus is covered so that the flow is forced to pass through curved separator arms 17 which are uniformly spaced around the circumference of cylinder 15*b*. The heavier liquid passes through the vapor to the outer sides of arms 17 and falls to a reservoir 19 at the bottom of module 12. The vapor rises passing through the dryers 13 and out to steam line 26.

Saturated water flows from the steam drum module through saturatedwater line 16 to a circulation pump module 18 to maintain a desired circulation ratio. Pump module 18, either steam or electrically driven can be a horizontal or vertical centrifugal type, however, a horizontal shaft pump is preferred for easy access and minimum space. Pump 18 is preferably located directly below the steam drum module 12 to provide adequate net positive suction head to the pump module 18 at all times.

The circlating water from module 18 flows via line 20 to the lower header of closely-spaced, vertical tubes 21 of a cylindrical furnace module 22. The tubes 21 form both a cylindrical combustion chamber and water wall and act as a heat transfer surface. Gas flows downward along the tubes 21 to a water wall gas outlet 23. Water counterflows through tubes 21 to the upper header. The gas outlet 23 includes an integral circular flange connected to a superheater module 32. The steam and water mixture generated in tubes 21 flow from the top header through pipe 24 to the bottom inlet of steam drum module 12. Furnace module 22 is flanged and divided at its center into two modules for providing smaller, more easily replaceable portions of the furnace module. Bypass headers 31 provide continuity of waterflow from the headers in the lower portion to those in the upper portion at the interconnecting flange 23*a* of furnace module 22.

Externally attached by an integral circular flange 25 to the top of the furnace module 22 is a burner module 28 having three equally spaced burners 29 and a compressed air inlet fed from a supercharger 46 through a line 30. Fuel injected into module 28 through burners 29 mixed with the compressed air from supercharger 46 ignites and creates the hot gases which flow downward through furnace module 22.

Water from pump 18 is fed through pipe 20 to a superheater module 32. Superheater module 32 externally interfaced with module 22 is comprised of a water wall tube 34 and a superheater tube bundle 36. Bundle 36 consists of tube platens bent to a serpentine configuration that are connected to the inlet end of a header which receives steam from steam drum module 12 via line 26. The inlet flow into the header flows through the platens, returns as superheated steam to the outlet end of the header and then through line 27 to the ships' propulsion turbines. A small portion of the superheated steam is bled back through line 27 to a desuperheating coil in steam drum module 12 to provide lower temperature steam for auxiliary purposes. The header sees an inlet steam temperature of 575° F. and an outlet superheated steam temperature of 975° F. A header box is complete with top and bottom plates, to form a rectangular opening in the side of the vessel. The water wall tube 34 is formed from tubes in a circumferential pattern providing a vertical spacing for interface with the superheater bundle 36. The superheater module 32 is configured for easy replacement, having quick disconnecting couplings 35*a* and 35*b* for connection, respectively, with the adjacent furnace module 22 on one end and a convection module 40 on the other end.

Convection module 40 consists of steam generating tube bundle 37, headers, gas flow paths, baffles, and quick disconnect couplings 41 and 42 for externally interfacing or joining to the adjacent superheater module 32 and a super charger module 46, respectively. Bundle 37 is a helical coil which includes welded water wall tubes 38 which protect the outer shell. Inlet line 20 is connected to feed water through the bottom inlet header to bundle 37. An outlet header connects bundle 37 to outlet line 24. The water wall tubes 38 are fed and discharged in the same manner as furnace module 22. Bottom headers are connected to inlet line 20 and feed the water wall tubes 38 to a top ring header connected to line 24 for return of the steam and water mixture to steam drum module 12. The floor of convection module 40 is contoured so as to assist the gas from superheater module 32 to turn upward and into the bundle 37 while the top closure head forms the gas plenum for the exit of the gas through a large diameter gas outlet pipe 44.

Supercharger module 46 having an air intake 47 and a hot gas outlet 48 is connected to receive through line 44 the hot gases from convection module 40. Module 46 supplies compressed air through pipe 30 for combustion in burner module 28 and furnace module 22. Supercharger module 46 is comprised of a turbo compressor, an axial flow compressor, and an integral reaction gas turbine which utilizes the exhaust gas flow from convection module 40 to drive the compressor. The turbocompressor will not self-sustain at all speeds, so an attached steam turbine is used to provide additional power. This turbine also provides power for rapid acceleration. An electric motor used for start up, drives through a gear train which automatically disengages when the supercharger develops enough power to accelerate above the starting speed. Module 46 is designed to be self governing and is readily removable and replaceable as a complete module.

Figure 1:
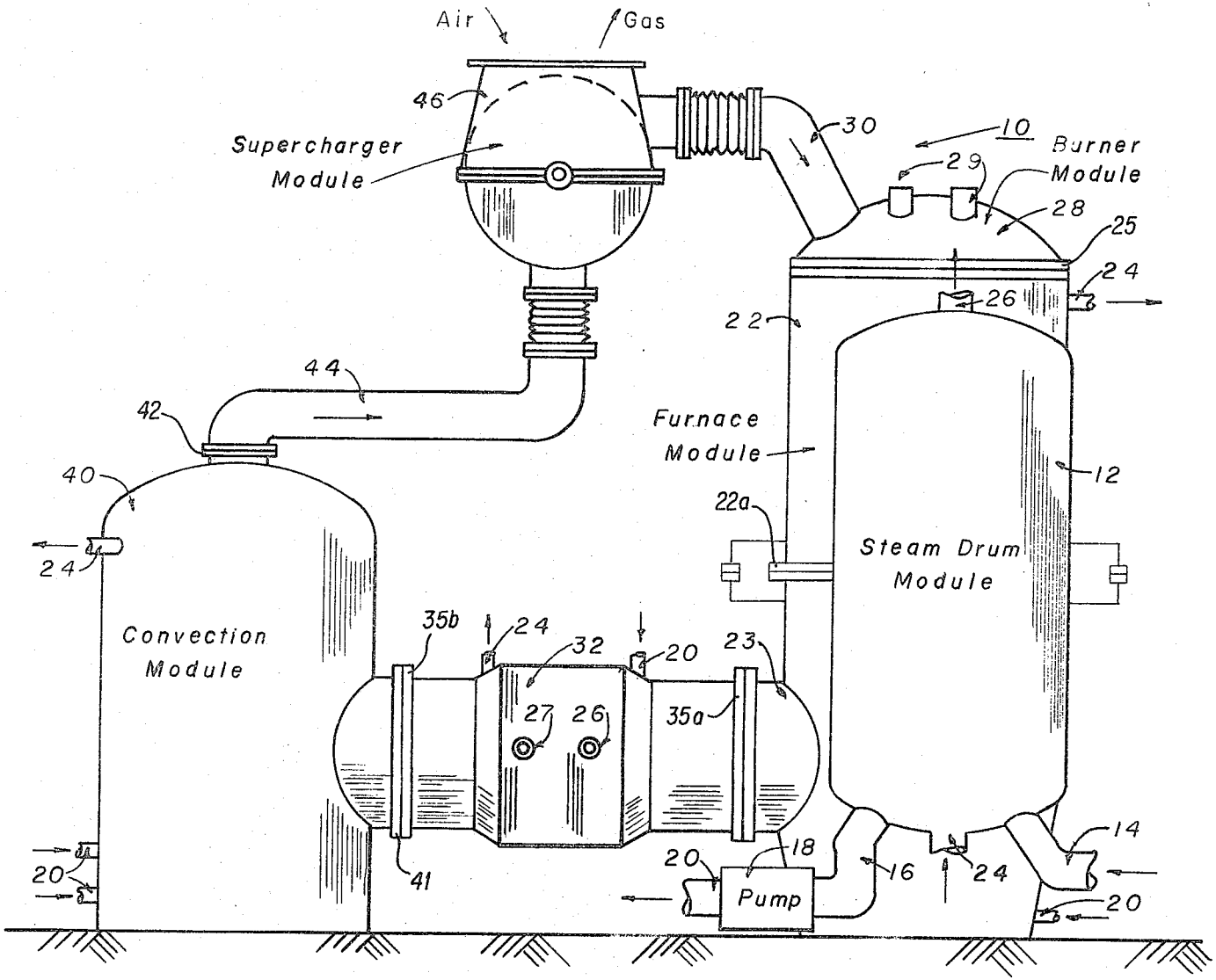
FIG. 1 is a side elevation of a preferred embodiment of a standardized compact modular boiler according to the invention.
Figure 2:
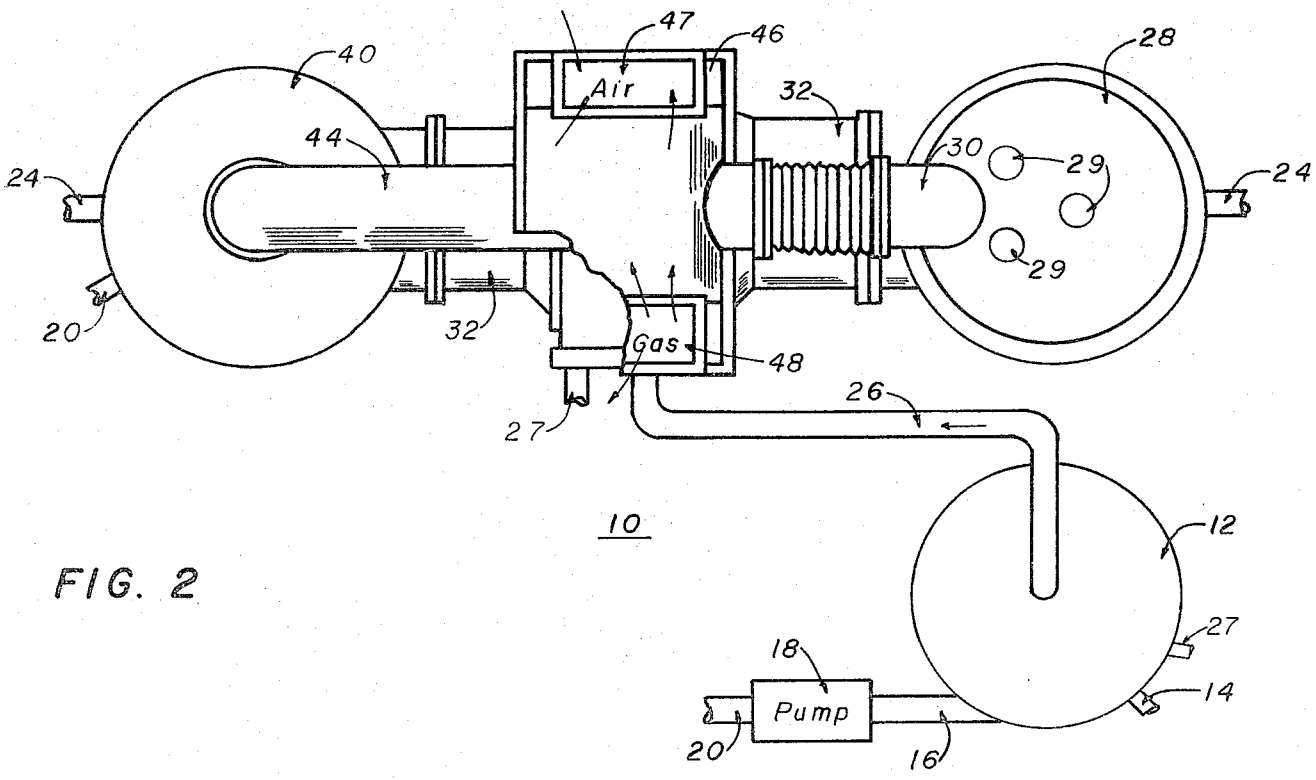
FIG. 2 is a plan view of the boiler of FIG. 1.

Operation of the standardized, compact, modular boiler for providing steam power for propulsion of a ship is now summarized with reference to FIGS. 1–3. Fuel is supplied through burners 29 into burner module 28. Air is supplied under pressure from supercharger module 46 through pipe 30 into burner module 28. Combustion of the air and fuel mixture creates hot gases which flow through externally interfaced modules 22, 32 and 40 and into supercharger module 46. A portion of the heat from the hot gases is transferred to the working fluid (water) flowing in the tube bundles as the gases flow through the respective modules. The hot gas from convection module 40 passing through pipe 44 to supercharger module 46 after being utilized to operate a gas turbine therein is exhausted through outlet 48 to the atmosphere. The gas turbine drives an air compressor located in the supercharger module where it takes in atmospheric air through inlet 47 and compresses it. This air goes to the burner module 28 where as stated previously, it mixes with injected fuel for combustion.

The working fluid flows into steam drum module 12 to create a reservoir therein. The water flows from a feed water outlet line 16 located on drum module 12 to pump 18 which circulates the water to the various modules. Water from pump 18 is fed through line 20 to furnace module 22 where it is heated by hot gases. A steam and water mixture flows from the top of furnace module 22 through line 24 to the bottom of steam drum module 12 wherein the steam and water are separated. Water returns to the reservoir at the bottom of steam drum module 12 whereas the steam rises upward and passes through dryers 13 to exit from line 26. Steam flows through line 26 into superheater module 32 where it is superheated by hot gases flowing from furnace module 22. Superheated steam line 27 from module 32 is connected to supply superheated steam from module 32 to ship propulsion turbines and to a desuperheater for auxiliary steam.

Therefore, some of the many advantages of the present invention should now be apparent. In summary, the compact modular boiler provides the burner, furnace, superheater and convection functions within separate housings each having externally connectable interfaces. As a result repair and overhaul are completed by quick replacement of defective component modules in lieu of tedious on-ship repair or rebuilding. Modules are repaired at shore based refit facilities and returned to a pool of modules available for use on any ship since modules are of standardized design. The amount of work required for the repair of an inoperable boiler is more accurately estimated since pretested modules replace downed boilers on a ship. The boiler is a singular design which permits one boiler configuration capacity to be used on all ships. Ships with a lower per boiler steam rate use the boiler on a one to one replacement for existing boilers. Ships with a greater per boiler steam capacity use a plurality of boilers to replace existing boilers. The proliferation of spare parts is significantly reduced as a result of module standardization. The training of qualified operators and mechanics is simpler since standard repair procedures exist. With a standard of 200,000 pounds per hour, for example, the boiler provides an available steam flow—over capacity of between 6% and 32% for all of the U.S. Navy's 1200 PSI's steam ships thus permitting increased steam capacity when required. Burner modules which accommodate different fuels may be incorporated in the future. The modular design allows quick and easy removal of any and all major components of the boiler. The combination of forced circulation of boiler water along with pressure fired combustion results in a boiler system having compact size and low height.

Obviously, many modifications of the present invention are possible in light of the above teachings. It is therefore to be understood that, within the scope of the appended claims, the invention may be practiced otherwise than as specifically described.

What is claimed is:

1. A standardized compact modular boiler, comprising, in combination:

a burner module for receiving and igniting a mixture of fuel and compressed air;

a furnace module externally connected by an integral flange with said burner module to receive the ignited fuel and compressed air mixture including a combustion chamber for generating and passing hot gas from said mixture and furnace tubes connected to receive the hot gas and saturated feedwater for generating a steam and water mixture;

a steam drum module connected to receive the steam and water mixture and input feedwater for providing dry steam and the saturated feedwater therefrom;

a superheater module externally connected by a quick disconnect coupling with said furnace module for receiving and passing the hot gas from said furnace module and including a superheater tube bundle for receiving said dry steam for providing a superheated steam;

a convection module externally connected by a quick disconnect coupling with said superheater module to receive and pass the hot gas from said superheater module and including a steam generating tube bundle connected to receive the saturated feedwater for providing the steam and water mixture therefrom;

a supercharger module adapted to receive air and connected to receive the hot gas passing from said convection module for heating and compressing the air supplied to said burner module; and a pump module connected to receive and force circulate the saturated feedwater from said steam drum module to said furnace, superheater and convection modules.

2. A standardized compact modular boiler as recited in claim 1, wherein each of said couplings and flange permits independent removal of the module associated therewith.

3. A standardized compact modular boiler as recited in claim 1, wherein said superheater module further comprises:

a wall tube bundle connected to receive the hot gas and the saturated feedwater for the providing the steam and water mixture.

* * * * *